US012527454B2

(12) United States Patent
Lim

(10) Patent No.: US 12,527,454 B2
(45) Date of Patent: Jan. 20, 2026

(54) DISHWASHER

(71) Applicant: SAMSUNG ELECTRONICS CO., LTD., Suwon-si (KR)

(72) Inventor: Kyungup Lim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 354 days.

(21) Appl. No.: 18/097,789

(22) Filed: Jan. 17, 2023

(65) Prior Publication Data

US 2023/0165429 A1 Jun. 1, 2023

Related U.S. Application Data

(63) Continuation of application No. PCT/KR2021/007784, filed on Jun. 22, 2021.

(30) Foreign Application Priority Data

Jul. 22, 2020 (KR) ..... 10-2020-0090716

(51) Int. Cl.
*A47L 15/42* (2006.01)

(52) U.S. Cl.
CPC ..... *A47L 15/4217* (2013.01); *A47L 15/4248* (2013.01)

(58) Field of Classification Search
None
See application file for complete search history.

(56) References Cited

U.S. PATENT DOCUMENTS 9,023,156 B2 5/2015 Han et al.
9,492,053 B2 11/2016 Shin et al.
9,861,253 B2 1/2018 Lee et al.
10,925,461 B2 2/2021 Kim et al.
2004/0103930 A1 6/2004 Lee
2005/0241675 A1 11/2005 Jung et al.

FOREIGN PATENT DOCUMENTS

CN 107485350 A 12/2017
EP 0 864 290 A2 9/1998
EP 0 931 503 A2 7/1999
(Continued)

OTHER PUBLICATIONS

International Search Report, PCT/ISA/210, dated Oct. 20, 2021, in PCT Application No. PCT/KR2021/007784.
(Continued)

*Primary Examiner* — Rita P Adhlakha
(74) *Attorney, Agent, or Firm* — STAAS & HALSEY LLP

(57) ABSTRACT

A dishwasher including a tub; and an air brake assembly to supply water into the tub. The air brake assembly includes: an air brake case, a first flow path inside the air brake case through which water to be introduced into the air brake case flows, an air brake disposed on the first flow path and configured to prevent backflow of water, an air brake chamber configured to accommodate water flowing out of the air brake, a second flow path connecting the air brake chamber to the tub to guide water in the air brake chamber to the tub, a water tank in the air brake case to store water having passed through the first flow path, and a partition dividing the water tank from the air brake chamber so that a highest level of water stored in the water tank is higher than a height of the air brake.

13 Claims, 9 Drawing Sheets

(56) References Cited

FOREIGN PATENT DOCUMENTS

| | | |
|---|---|---|
| EP | 2 440 107 A0 | 4/2012 |
| JP | 5982622 | 8/2016 |
| JP | 2019-208537 | 12/2019 |
| KR | 10-0457575 | 11/2004 |
| KR | 10-0772230 | 11/2007 |
| KR | 10-1054130 | 8/2011 |
| KR | 10-1070063 | 10/2011 |
| KR | 10-2013-0015287 | 2/2013 |
| KR | 10-1268824 | 5/2013 |
| KR | 10-1296003 | 8/2013 |
| KR | 10-2015-0029416 | 3/2015 |
| KR | 10-2018-0015930 | 2/2018 |
| KR | 10-2018-0088216 | 8/2018 |
| KR | 10-2019-0014896 | 2/2019 |
| KR | 10-2021-0130563 | 11/2021 |
| WO | WO 2010/142569 A1 | 12/2010 |

OTHER PUBLICATIONS

Written Opinion, PCT/ISA/237, dated Oct. 20, 2021, in PCT Application No. PCT/KR2021/007784.

DISHWASHER

CROSS-REFERENCE TO RELATED APPLICATIONS

This application is a continuation application of International Application PCT/KR2021/007784 filed Jun. 22, 2021, and claims foreign priority to Korean application 10-2020-0090716 filed Jul. 22 2020, the disclosures of which are incorporated herein by reference in their entireties.

BACKGROUND

1. Field

The disclosure relates to a dishwasher, and more specifically, to a dishwasher having an improved air brake assembly.

2. Description of Related Art

In general, a dishwasher refers to a device configured to wash dishware stored therein by spraying a high pressure washing water to the dishware and then dry the dishes. The dishwasher operates to spray washing water at a high pressure into a washing tub, in which dishes are accommodated, so that the sprayed washing water comes into contact with the dishes to remove foreign substances, such as food debris and the like, on the surface of the dishes.

Specifically, the dishwasher includes a tub, in which a washing tub is formed, and a sump mounted on the bottom of the tub to store washing water. By a pumping action of a washing pump mounted inside the sump, washing water is caused to move to a spray nozzle, and the washing water moved to the spray nozzle is sprayed at a high pressure through a spray hole formed at an end tip of the spray nozzle. The washing water sprayed at a high pressure hits the surface of the dishes, causing dirt, such as food debris, stuck on the dishes to be fallen to the bottom of the tub.

The dishwasher is provided with an air brake assembly that delivers supplied washing water to the sump. The air brake assembly may be basically provided with a flow meter function for detecting the amount of water supplied into the dishwasher and an air brake function for preventing a backflow of supplied water.

Recently, due to energy saving issues, more functions are being added. As one of the functions, a water tank for storing water supplied to the washing tub may be provided. The water tank may be provided to store washing water in advance such that cold water from a water supply is provided at a temperature corresponding to the room temperature without additional energy consumption, to thereby save energy used for heating In the water tank, basically, an unused space is required to prevent water stored in the water tank from back flowing from the air brake.

However, since water cannot be stored in the unused space of the water tank, there is a loss of space inside the water tank.

SUMMARY

Various aspects will be set forth in part in the description which follows and, in part, will be apparent from the description, or may be learned by practice of the presented embodiments A dishwasher according to an aspect of the disclosure includes: a tub; and an air brake assembly configured to supply water into the tub, wherein the air brake assembly includes: an air brake case; a first flow path inside the air brake case through which water to be introduced into the air brake case flows; an air brake disposed on the first flow path and configured to prevent backflow of water; an air brake chamber configured to accommodate water flowing out of the air brake; a second flow path connecting the air brake chamber to the tub to guide water in the air brake chamber to the tub; a water tank in the air brake case to store water having passed through the first flow path; and a partition dividing the water tank from the air brake chamber so that a highest level of water stored in the water tank is higher than a height of the air brake.

In addition, the partition may include a lower wall provided at a lower side of the air brake to form a bottom of the air brake chamber and configured to prevent water of the water tank from flowing into the air brake chamber.

In addition, the air brake assembly may further include a flow path wall formed on the air brake case to define the first flow path, and the partition may further include an upper wall forming a part of the flow path wall and connected to the lower wall to surround the air brake chamber.

In addition, the water tank may include an overflow path.

In addition, the overflow path may be formed on an upper portion of the flow path wall.

In addition, the overflow path may be formed at a position higher than a position of the air brake.

In addition, the overflow path may be located higher than the air brake chamber.

In addition, the overflow path may be connected to the second flow path.

In addition, the overflow path may be located higher than the second flow.

In addition, the air brake chamber may further include a guide part configured to guide water flowing out of the air brake.

In addition, the guide part may include a first guide rib connected to the air brake and formed with a first slope; and a second guide rib spaced apart from the first guide rib and having a second slope to guide water to the second flow path.

In addition, the air brake case may further include a tub connection hole to allow water moving through the second flow path to flow into the tub.

In addition, the first flow path may further include a flow velocity increasing member coupled to the flow path wall to reduce a cross-sectional area so that a flow velocity is increased.

In a dishwasher including an air brake assembly configured to supply water to a tub according to another aspect of the disclosure, the air brake assembly includes: an air brake case; a first flow path provided inside the air brake case and allowing water to be introduced therethrough; an air brake disposed on the first flow path and configured to prevent backflow of water; an air brake chamber communicating with the air brake and configured to accommodate water flowing out of the air brake; a second flow path connecting the air brake chamber to the tub so that water in the air brake chamber is guided to the tub; a water tank provided in the air brake case to store water having passed through the first flow path therein; and an overflow path formed at a position higher than a position of the air brake such that a highest level of water stored in the water tank is higher than a height of the air brake.

In addition, the air brake assembly may include a partition configured to divide the water tank from the air brake chamber.

In addition, the partition may further include a lower wall provided at a lower side of the air brake to form a bottom of the air brake chamber and configured to prevent water of the water tank from flowing into the air brake chamber.

In addition, the air brake assembly may further include a flow path wall formed on the air brake case to define the first flow path, wherein the partition may further include an upper wall forming a part of the flow path wall and connected to the lower wall to surround the air brake chamber.

In addition, the overflow path may be formed on an upper portion of the flow path wall.

In addition, the overflow path may be formed at a position higher than a position of the air brake.

In addition, the overflow path may be located to be higher than the second flow.

BRIEF DESCRIPTION OF THE DRAWINGS

Above and other aspects, features, and advantages of various embodiments of the present disclosure will be more apparent from the following description taken in conjunction with the accompany drawings, in which.

DETAILED DESCRIPTION

Figure 1:
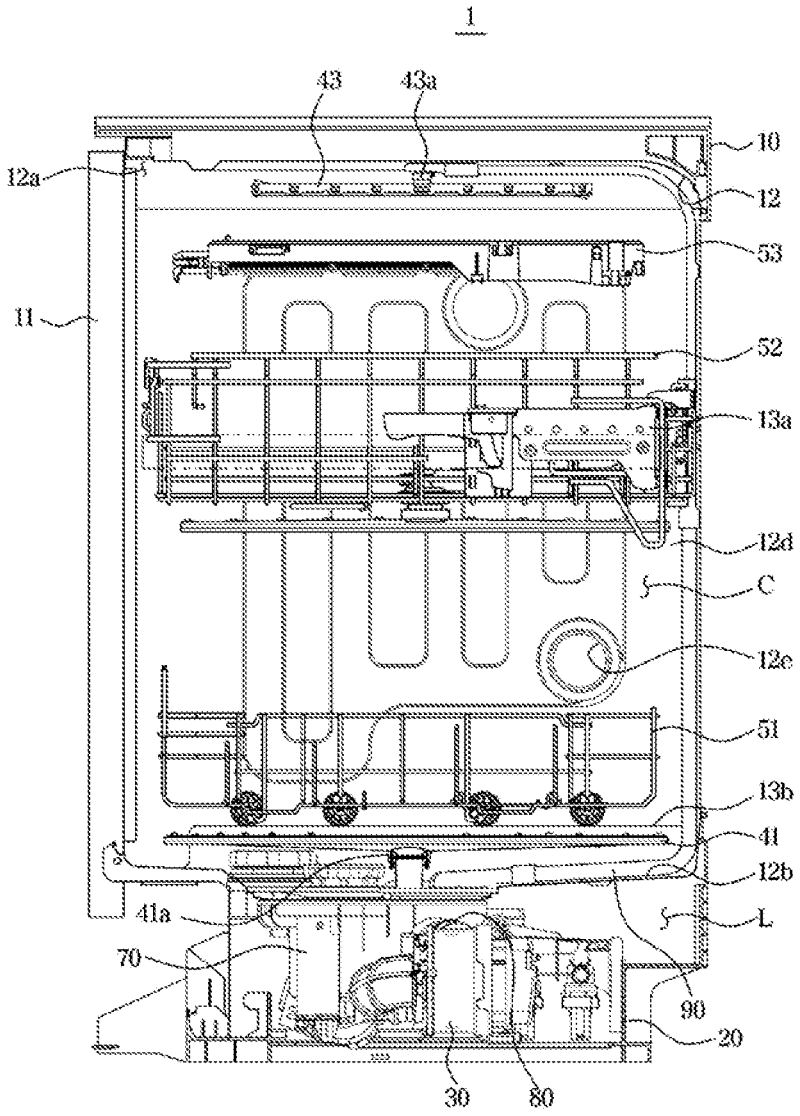
FIG. 1 is a cross-sectional view illustrating a dishwasher according to an embodiment of the disclosure.

The embodiments set forth herein and illustrated in the configuration of the disclosure are only the most preferred embodiments and are not representative of the full technical scope of the disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

According to various embodiments of the disclosure, a dishwasher is implemented to improve the structure of an air brake assembly to increase a storage capacity of a water tank.

Moreover, according to various embodiments of the disclosure, a dishwasher is implemented to isolate an air-brake inside a water tank of an air brake assembly to increase a storage capacity of the water tank.

Further, according to various embodiments of the disclosure, a dishwasher is implemented to allow an overflow inside a water tank of an air brake assembly to be located at a position higher than an air brake so that the amount of water to be stored is increased and energy consumption is reduced.

According to various embodiments of the disclosure, an air-brake inside a water tank of an air brake assembly is isolated so that a storage capacity of the water tank can be increased.

In addition, according to various embodiments of the disclosure, an overflow of a water tank is located at a position higher than an air brake so that the amount of water to be stored can be increased and energy consumption can be reduced.

Hereinafter, embodiments according to the disclosure will be described in detail with reference to the accompanying drawings.

Figure 2:
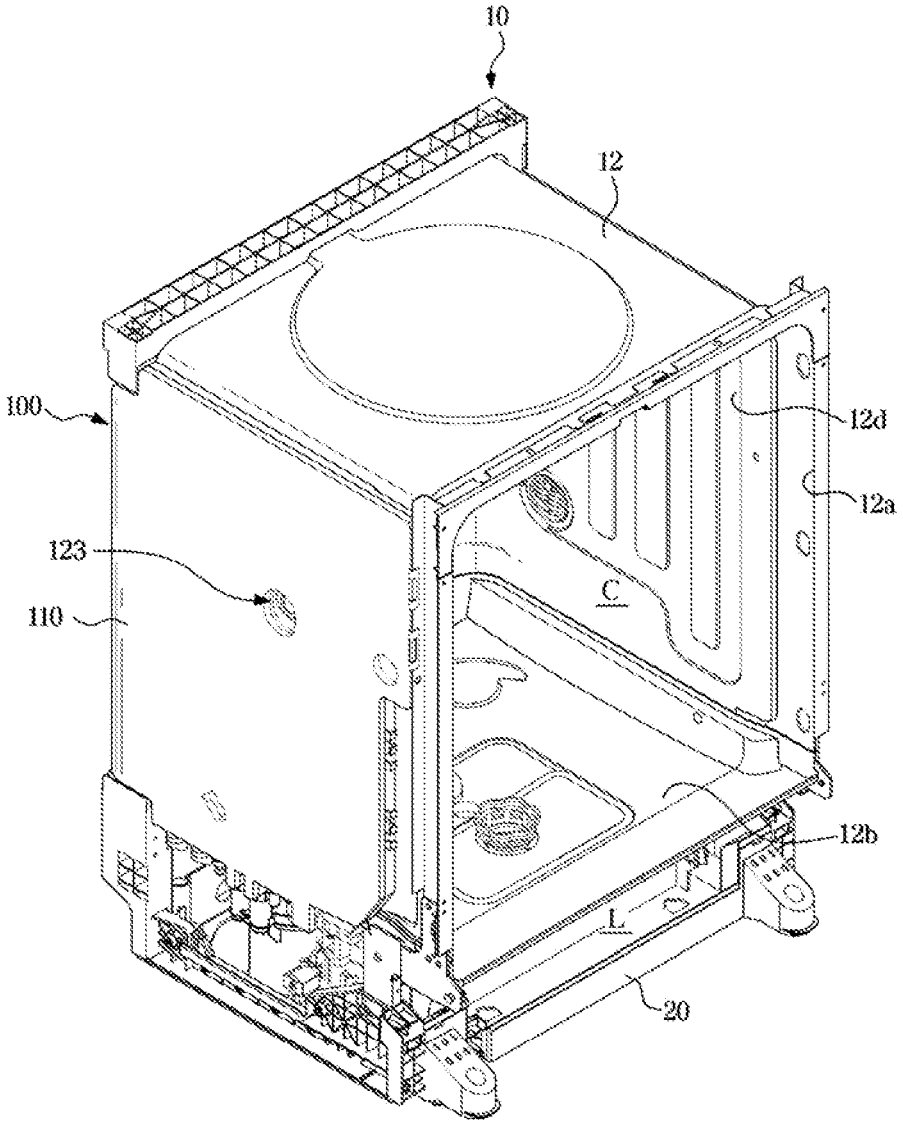
FIG. 2 is a perspective view illustrating an air brake assembly mounted on a tub according to an embodiment of the disclosure.

FIG. 1 is a cross-sectional view illustrating a dishwasher according to an embodiment of the disclosure, and FIG. 2 is a perspective view illustrating an air brake assembly mounted on a tub according to an embodiment of the disclosure;

Referring to FIGS. 1 to 2, a dishwasher 1 may include a body 10 that forms an exterior thereof.

The dishwasher 1 may further include a tub 12 provided inside the body 10. The tub 12 may be provided in a substantially box shape. One surface of the tub 12 may be open. That is, the tub 12 may have an opening 12. As an example, a front surface of the tub 12 may be open.

The dishwasher 1 may further include a door 11 provided to open and close the opening 12*a* of the tub 12. The door 11 may be installed on the body 10 to open and close the opening 12*a* of the tub 12. The door 11 may be rotatably installed on the body 10.

The dishwasher 1 may further include a storage container provided inside the tub 12 and accommodating dishes therein. The storage container may include a plurality of baskets 51, 52, and 53. Dishes having a relatively large volume may be accommodated in the plurality of baskets 51, 52, and 53. However, the types of dishes accommodated in the plurality of baskets 51, 52, and 53 are not limited to dishes having a relatively large volume. That is, in the plurality of baskets 51, 52, and 53, not only relatively large-volume dishes but also relatively small-volume dishes may be accommodated.

The plurality of baskets 51, 52, and 53 may include an intermediate basket 52 positioned at a middle portion in the height direction of the dishwasher 1 and a lower basket 51 positioned at a lower portion in the height direction of the dishwasher 1. The intermediate basket 52 may be provided to be supported by an intermediate guide rack 13*a,* and the lower basket 51 may be provided to be supported by a lower guide rack 13*b.* The intermediate guide rack 13*a* and the lower guide rack 13*b* may be installed on side surfaces 12*d* of the tub 12 to enable sliding toward the opening 12*a* of the tub 12a. The side surfaces 12*d* of the tub 12 may be a concept including an inner surface of a right wall and an inner surface of a left wall of the tub 12.

The storage container may include an upper basket 53 positioned at an upper portion in the height direction of the dishwasher 1. The upper basket 53 is formed in the form of a rack assembly so that dishes having a relatively small volume may be accommodated therein. Preferably, cooking tools or cutlery, such as a ladle, a knife, and a spatula, may be accommodated in the upper basket 53. In addition, a small cup, such as an espresso cup, may be accommodated in the rack assembly. However, the types of dishes accommodated in the upper basket 53 are not limited to the above example.

The dishwasher 1 may further include a sump 70 for storing washing water. The dishwasher 1 may include a washing chamber C, which is a space formed by the inside of the tub 12. The washing chamber C is a space in which dishes mounted on the baskets 51, 52, and 53 may be washed by washing water and dried.

The washing chamber C may be defined as an inner space of the tub 12 formed by side surfaces 12*d,* front and rear surfaces, and a lower surface 12*b,* of the tub and the sump 70 communicating with the lower surface 12*b.*

The dishwasher 1 may further include spraying units 41, 42, and 43 provided to spray washing water. The spraying units 41, 42, and 43 include a first spraying unit 41 disposed at a lower portion of the lower basket 51 in the height direction of the dishwasher 1, a second spraying unit 52 disposed at a lower portion of the intermediate basket 52 in the height direction of the dishwasher 1, and a third spraying unit 53 disposed at a lower portion of the upper basket 53 in the height direction of the dishwasher 1.

The first spraying unit 41 may be provided to be rotatable about a rotation shaft 41*a,* the second spraying unit 42 may be provided to be rotatable about a rotation shaft 42*a* , and the third spraying unit 43 may be provided to be rotatable about a rotation shaft 43*a.*

However, the disclosure is not limited to the first embodiment, and the first spraying unit 41 may be fixed to one side of the lower surface 12*b,* unlike the second spraying unit 42 and the third spraying unit 43. In this case, the first spraying unit 41 is provided to spray washing water in an approximately horizontal direction by a fixed nozzle, and the washing water sprayed horizontally from the nozzle of the first spraying unit 41 is diverted by a diverting assembly disposed in the washing chamber C to be directed upward. The diverting assembly is mounted on the rail by a holder, and may be provided to translate along the rail.

The third spraying unit 43 may spray washing water toward dishes stored in the upper basket 53 and the intermediate and lower baskets 52 and 51, and the second spraying unit 42 may spray washing water toward dishes stored in the intermediate basket 52 and the upper basket 53.

The first spraying unit 41, unlike the second spraying unit 42 and the third spraying unit 43, may be disposed on the lower surface 12*b* of the tub 12. In detail, the first spraying unit 41 may be provided to be fixed to the sump 70.

The dishwasher 1 may include a circulation pump 30 for pumping water stored in the sump 70 to the spraying units 41, 42, and 43. The washing water pumped by the circulation pump 30 may pass through an alternating device 80, which is connected to the circulation pump 30, so that the water may be supplied to the first spraying unit 41, or moved upward through a duct 90 and then supplied to the second spraying unit 42 or the third spraying unit 43.

As described above, washing water stored in the sump 70 or washing water flowing into the dishwasher 1 from the outside may be provided to flow to the alternating device 80 by the circulation pump 30. The alternating device 80 may provide washing water to the first spraying unit 41 through a connector (not shown) connected to the first spraying unit 41, and may provide washing water to the duct 90 through a flow path 62 connected to the duct 90.

The alternating device 80 may selectively provide washing water to at least one of the connector and the duct 90. The alternating device 80 may be disposed in a machine room L provided below the washing chamber C.

The dishwasher 1 may include a machine room L disposed below the tub 12. The machine room L may be formed by a lower frame 20.

In the machine room L, the above described components, such as the circulation pump 30, the sump 70, the alternating device 80, and the like may be disposed, and a water supply hose 131*a* and a drain hose 137*a,* which will be described below, may be disposed (see FIG. 7).

The dishwasher 1 may include the water supply hose 131*a* provided to supply washing water from the outside to the inside of the tub 12 and the drain hose 137*a.*

The dishwasher 1 may include the water supply hose 131*a* provided to supply washing water from the outside to the inside of the tub 12. One end of the water supply hose 131*a* may be connected to an air brake assembly 100 communicating with the tub 12. The other end of the water supply hose 131*a* may be connected to an external water supply source (not shown) by passing through the lower frame 20.

The air brake assembly 100 is provided to be connected to a connection hole 12*e* formed in the side surface 12*d* of the tub 12.

The air brake assembly 100 includes an air brake case 110. The air brake case 110 may further include a tub fixing part 123 provided to fix the air brake assembly 100 to the side surface 12*d* of the tub 12 (see FIG. 3). The tub fixing part 123 may be provided in at least one unit thereof.

The air brake case 110 may be formed in a shape and size corresponding to the side surface 12*d* of the tub 12. In the embodiment of the disclosure, the air brake case 110 is illustrated as having a size and a shape corresponding to the side surface 12*d* of the tub 12a, but the scope of the disclosure is not limited thereto. For example, the air brake case may be formed smaller than the tub.

Figure 3:
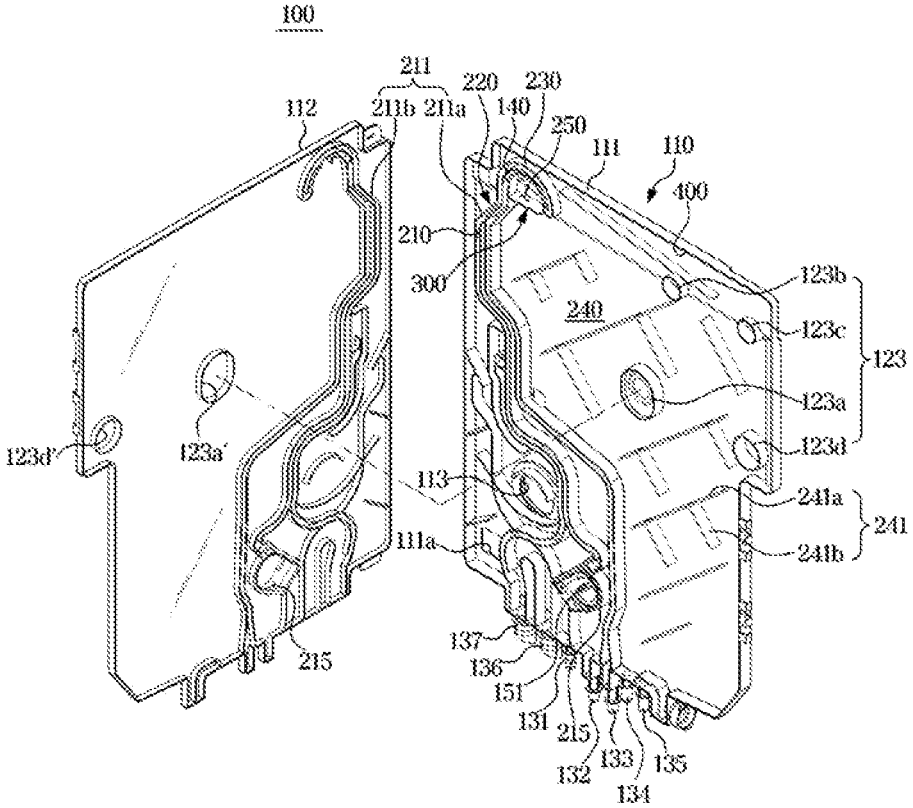
FIG. 3 is an exploded perspective view illustrating an air brake case according to an embodiment of the disclosure.
Figure 4:
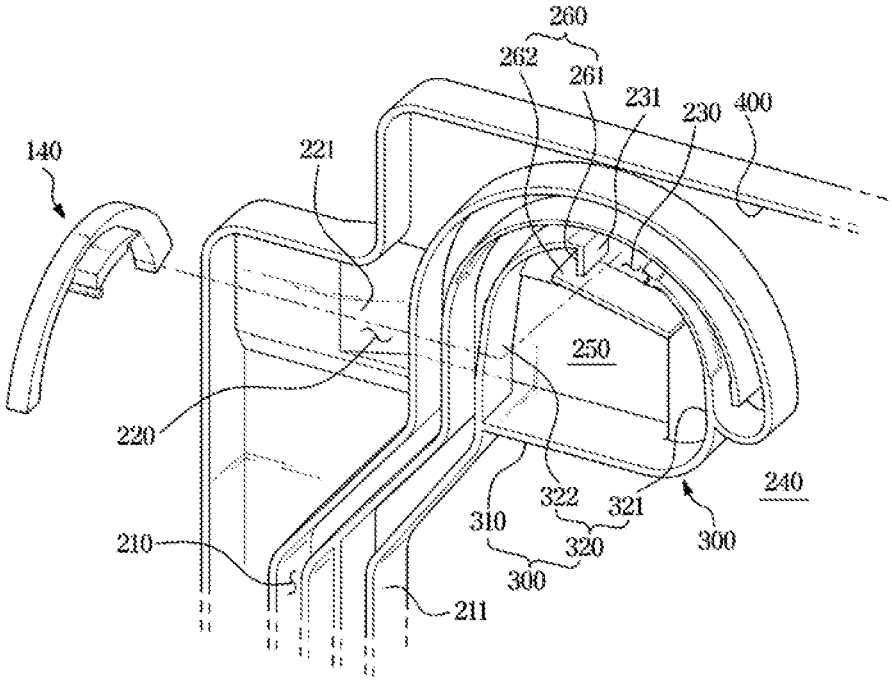
FIG. 4 is a partial enlarged perspective view illustrating an air brake according to an embodiment of the disclosure.
Figure 5:
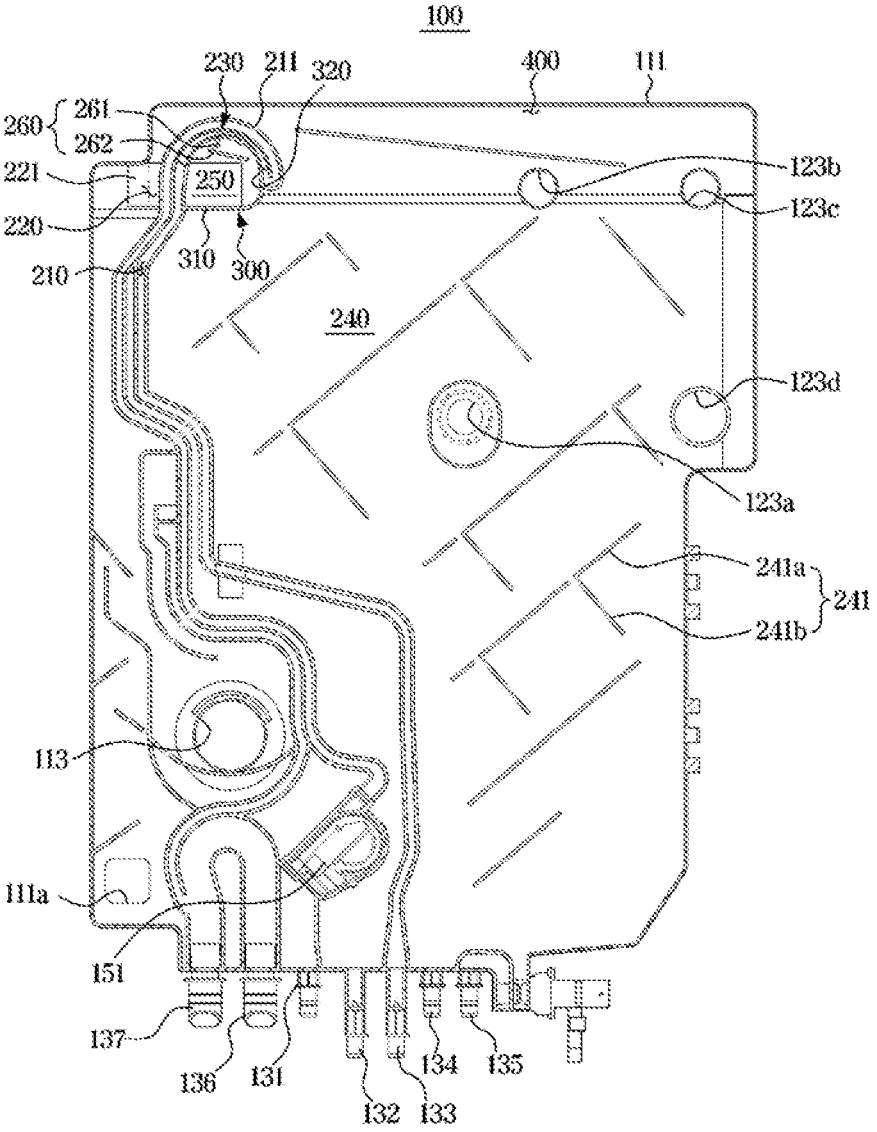
FIG. 5 is a cross-sectional view illustrating an air brake case according to an embodiment of the disclosure.
Figure 6:
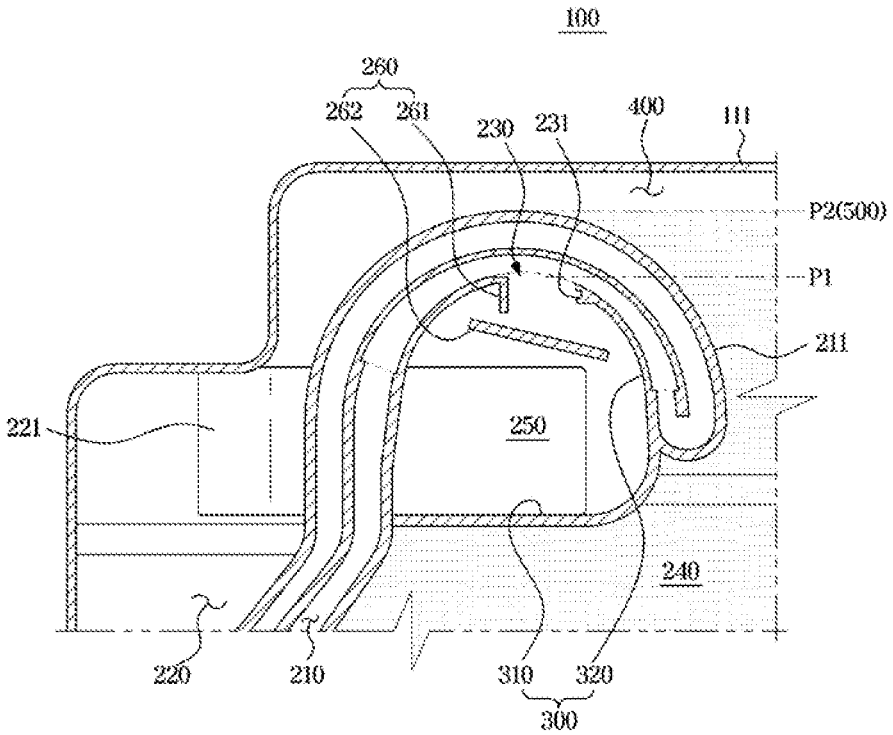
FIG. 6 is a view illustrating a maximum water level of a water tank by a partition of an air brake assembly according to an embodiment of the disclosure.

FIG. 3 is an exploded perspective view illustrating an air brake case according to an embodiment of the disclosure, FIG. 4 is a partially enlarged perspective view illustrating an air brake according to an embodiment of the disclosure, FIG. 5 is a cross-sectional view illustrating an air brake case according to an embodiment of the disclosure, and FIG. 6 is a view illustrating a maximum water level of a water tank by a partition of an air brake assembly according to an embodiment of the disclosure.

Referring to FIGS. 3 to 6, the air brake assembly 100 may be provided to supply washing water into the tub 12. The air brake assembly 100 may be mounted on the tub 12. The air brake assembly 100 may be mounted on the side surface 12*d* of the tub 12.

The air brake assembly 100 may include an air brake case 110. The air brake case 110 may include a first air brake case 111 and a second air brake case 112. The air brake case 110 may be formed by coupling the first air brake case 111 and the second air brake case 112 to each other.

The first air brake case 111 is provided to be coupled to the tub 12. The first air brake case 111 is provided to be in contact with and coupled to the side surface 12*d* of the tub 12. The first air brake case 111 may be provided on at least a portion thereof with an air hole 111*a* for discharging air to the outside or introducing air from the outside.

The first air brake case 111 may be provided with a tub communication hole 113 communicating with the tub 12 to introduce air into or discharge air from the tub 12. The tub communication hole 113 may be connected to the connection hole 12*e* formed in the side surface 12*d* of the tub 12.

The first air brake case 111 and the second air brake case 112 may be coupled to each other to form the air brake case 110.

The air brake case 110 may be provided with a tub fixing part 123 for coupling the air brake assembly 100 to the tub 12. The tub fixing part 123 may be provided in at least one unit thereof. The tub fixing part 123 may be provided on the first air brake case 111. At least some of the tub fixing parts 123 may be provided on the second air brake case 112. The air brake case 110 may be fixed to the side surface 12*d* of the tub 12 through the tub fixing part 123.

The tub fixing part 123 may include a first tub fixing part 123*a*, a second tub fixing part 123*b*, a third tub fixing part 123*c*, and a fourth tub fixing part 123*d* formed in the first air brake case 111. The first tub fixing part 123*a* to the fourth tub fixing part 123*d* may be disposed to be spaced apart from each other. In the embodiment of the disclosure, the first to fourth tub fixing parts 123*a* to 123*d* are illustrated as being spaced apart from each other inside the water tank 240, but the scope of the disclosure is not limited thereto. For example, the number of tub fixing parts may vary according to the size of the air brake case and the size and shape of the tub.

In addition, the tub fixing part 123 may include a fifth tub fixing part 123*a*' and a sixth tub fixing part 123*d*' formed at positions corresponding to the first tub fixing part 123*a* and the fourth tub fixing part 123*d* of the second air brake case 112. The fifth tub fixing part 123*a*' and the sixth tub fixing part 123*d*' may be formed to be coupled to the first tub fixing part 123*a* and the fourth tub fixing part 123*d* while corresponding thereto.

The air brake assembly 100 may include an air hole 111*a*. The air hole 111*a* may be formed in the air brake case 110. The air hole 111*a* may be formed in a lower left portion of the first air brake case 111. The air hole 111*a* may allow external air to be introduced into the tub 12 therethrough, or allow air present in the tub 12 to be discharged to the outside. Although the air hole 111*a* is illustrated as being formed in the first air brake case 111 of the air brake assembly 100 in the embodiment of the disclosure as an example, the scope of the disclosure is not limited thereto.

The air brake assembly 100 may further include a first flow path 210 provided inside the air brake case 110 and provided to allow washing water to flow therein.

The air brake assembly 100 may include an air brake 230 disposed on the first flow path 210 and provided to prevent backflow of water. The air brake 230 may be provided on a path of the first flow path 210. The air brake 230 may include an air brake hole 231 formed as an opening in at least a portion of the first flow path 210.

The air brake assembly 100 may further include an air brake chamber 250 communicating with the air brake 230 and provided to accommodate water discharged from the air brake 230.

The air brake assembly 100 may include a second flow path 220 connecting the air brake chamber 250 to the tub 12 so that water in the air brake chamber 250 is guided to the tub 12.

The air brake assembly 100 may include a water tank 240 provided in the air brake case 110 to store water that has passed through the first flow path 210 therein.

The air brake assembly 100 may include a partition 300 provided to divide the water tank 240 from the air brake chamber 250 so that the highest level of water stored in the water tank 240 is higher than the height of the air brake 230.

The air brake assembly 100 includes a water supply pipe 131 formed at a lower end portion of the air brake case 110 and allowing water to be supplied from the outside, a regeneration water input pipe 132 allowing regeneration water stored inside the air brake case 110 to be released, a water softener connection part 133 allowing water introduced into the air brake case 110 to move to a water softener (see FIG. 5), a sump drain connection part 136 connected to the sump such that washing water, after completing the washing, is discharged to the outside by the drain pump (not shown), and a drain hose connection part 137 allowing water on the sump drain connection part 136 to be discharged to the outside.

The air brake assembly 100 may include a water tank inlet 134 formed at a lower end portion of the air brake case 110 and allowing water in the water softener 160 to be introduced into the water tank 240, and a sump connection part 135 provided to allow water stored therein to flow out. The water tank inlet 134 and the sump connection part 135 may be located at a lower end portion of the water tank 240 of the air brake case 110.

The water tank 240 of the air brake assembly 100 may be provided inside the air brake case 110. The water tank 240 may be formed between the first air brake case 111 and the second air brake case 112. The water tank 240 may be formed inside the first air brake case 111.

The water tank 240 may include a plurality of ribs 241 for guiding movement of water for the water to smoothly move through the water tank inlet 134 and the sump connection part 135. The rib 241 may include a first rib 241*a* disposed in an oblique line and a second rib 241*b* disposed in a direction perpendicular to the first rib 241*a*. A plurality of first ribs 241*a* may be disposed to be spaced apart from each other and a plurality of second ribs 241*b* may be disposed to be spaced apart from each other. The plurality of ribs 241 may be provided to facilitate the movement of water in the water tank 240.

The water supply pipe 131 and the water softer connection part 133 of the air brake assembly 100 may be provided to be connected to the first flow path 210. The first flow path 210 of the air brake assembly 100 may be formed by a flow path wall 211 formed inside the air brake case 110. The first flow path 210 may be formed in each of the first air brake case 111 and the second air brake case 112*a*. The first flow path 210 may be formed by a first flow path wall 211*a* formed on the first air brake case 111 and a second flow path wall 211*b* formed on the second air brake case 112. The flow path wall 211 formed on the first air brake case 111 and the flow path wall 211 formed on the second air brake case 112 may be formed to correspond to each other and be connected to each other. The first flow path wall 211*a* formed on the first air brake case 111 and the second flow path wall 211*b* formed on the second air brake case 112 may be connected to each other to form the first flow path 210. In the embodiment of the disclosure, the flow path walls are illustrated as being respectively provided, but the scope of the disclosure is not limited thereto. For example, the first flow path may be formed by the first flow path wall formed on the first air brake case and the inner surface of the second air brake case.

The first flow path 210 of the air brake assembly 100 has at least a portion thereof bent to have a predetermined curvature inside the air brake case 110. The first flow path 210 is provided to include at least one bent portions to ensure flow stability of inflowing water.

The air brake 230 of the air brake assembly 100 may be disposed on the first flow path 210. The air brake 230 may be disposed in a portion of the first flow path 210. The air brake 230 may be positioned at a bent portion located on an upper side among the one or more bent portions of the first flow path 210. The air brake 230 may include an air brake hole 231 formed as an opening in at least a portion of the first flow path 210 to prevent a siphon shape from occurring when supply of water is stopped. The air brake 230 may further include a flow velocity increasing member 140 installed in the first flow path 210 to increase the flow velocity. The flow velocity increasing member 140 is coupled to the flow path wall 211 to reduce the cross-sectional area of the first flow path 210 to increase the flow velocity.

The air brake assembly 100 may be provided with a sensor 151 for detecting the amount of washing water flowing into the air brake case 110. The sensor 151 may be provided in the first flow path 210. The sensor 151 may be installed in the first flow path 210 to detect the amount of washing water introduced through the water supply pipe 131. The sensor 151 may be installed in a sensor installation part 215 formed in the air brake case 110. The sensor installation part 215 may be formed in each of the first air brake case 111 and the second air brake case 112*a*. The sensor installation part 215 may be formed on the path of the first flow path 210.

The air brake chamber 250 of the air brake assembly 100 may be formed to communicate with the air brake 230 of the first flow path 210, and provided to accommodate water flowing out from the air brake 230.

The air brake chamber 250 may be formed by the partition 300 connected to the flow path wall 211 forming the first flow path 210. The air brake chamber 250 may be provided to divide the water tank 240 from the air brake chamber 250. The air brake chamber 250 may be provided so that the highest level of water stored in the water tank 240 is higher than the height of the air brake 230.

The air brake chamber 250 may include a guide part 260 for guiding the water flowing out from the air brake 230. The guide part 260 includes a first guide rib 261 connected to the air brake 230 and formed with a first slope, and a second guide rib 262 spaced apart from the first guide rib 261 and formed with a second slope to guide water to the second flow path 220. The second guide rib 262 may be disposed below the first guide rib 261. The second guide rib 262 may be positioned at a lower side of the air brake 230. The second guide rib 262 may be located at a lower side of the air brake hole 231.

The air brake case 110 may include a water flow wall 221 that forms the second flow path 220 connecting the air brake chamber 250 to the tub 12 such that the water in the air brake chamber 250 is guided to the tub 12. The water flow wall 221 may be formed on the first air brake case 111. The water flow wall 221 may be formed by at least a portion of the first air brake case 111 being recessed backward. The water flow wall 221 may be formed to be connected to at least a portion of the air brake chamber 250. The water flow wall 221 may be formed to connect between the air brake chamber 250 and the tub 12.

The water flow wall 221 may be provided to form at least a portion of the second flow path 220 formed to allow water flowing out through the air brake hole 231 of the air brake 230 to be guided to the tub 12. Another portion of the second flow path 220 may be formed by the flow path wall 211 forming the first flow path 210 in the air brake case 110. The second flow path 220 may be formed between the air brake chamber 250 and the tub communication hole 113.

The second flow path 220 may be connected to an overflow path 400 of the water tank 240 to be described below.

The partition 300 is provided at a lower side of the air brake 230 to form the bottom of the air brake chamber 250. The partition 300 may further include a lower wall 310 that prevents water of the water tank 240 from flowing into the air brake chamber 250.

The air brake chamber 250 is divided from the water tank 240 by a portion of the flow path wall 211 forming the first flow path 210 and the lower wall 310 of the air brake chamber 250, so that the air brake chamber 250 is divided from the water tank 240 inside the air brake case 110.

Accordingly, water of the water tank 240 may be prevented from flowing into the air brake chamber 250.

In addition, the partition 300 may include the upper wall 320 forming a portion of the flow path wall 211 and connected to the lower wall 310 to surround the air brake chamber 250.

The upper wall 320 may include a first upper wall 321 extending from one side of the lower wall 310 and a second upper wall 322 extending from the other side of the lower wall 310. The first upper wall 321 and the second upper wall 322 may each be provided to be connected to the flow path wall 211. The first upper wall 321 and the second upper wall 322 may each form a portion of the flow path wall 211, and may be formed to be connected to the flow path wall 211.

The air brake chamber 250 may be divided from the water tank 240 by at least a portion of the flow path wall 211 forming the first flow path 210 and at least a portion of the upper wall 320 formed by extending from the lower wall 310 of the air brake chamber 250 so that the air brake chamber 250 may be divided from the water tank 240 inside the air brake case 110.

Accordingly, water in the water tank 240 may be stored up to a height P2 higher than a height P1 of the air brake 230 in the water tank 240 without flowing into the air brake chamber 250, so that the storage capacity of the water tank 240 of the air brake assembly 100 may be increased.

In addition, the water tank 240 includes the overflow path 400 provided at a height P2 higher than a height P1 of the air brake 230. The overflow path 400 of the water tank 240 is provided to be located higher than the air brake 230. The overflow path 400 of the water tank 240 may be formed on an upper portion of the flow path wall 211. The overflow path 400 may be connected to the second flow path 220. The overflow path 400 is provided to be located to be higher than the air brake chamber 250.

Accordingly, water overflowing from the water tank 240 is caused to move to the second flow path 220 through the overflow path 400, and then guided to the tub 12. Since the overflow path 400 of the water tank 240 is located to be higher than the air brake chamber 250, the highest level of water stored in the water tank 240 may be formed higher than the height of the air brake 230, to thereby increase the storage capacity of the water tank 240.

Figure 7:
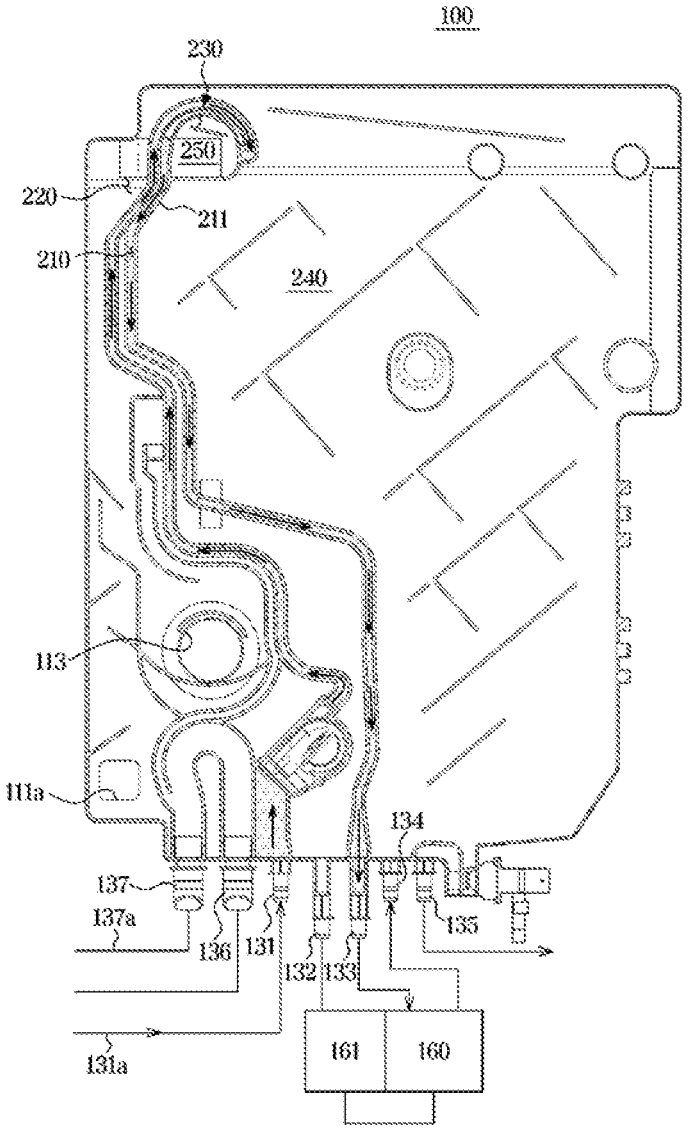
FIG. 7 is a view illustrating a first flow path during supply of water of an air brake assembly according to an embodiment of the disclosure.
Figure 8:
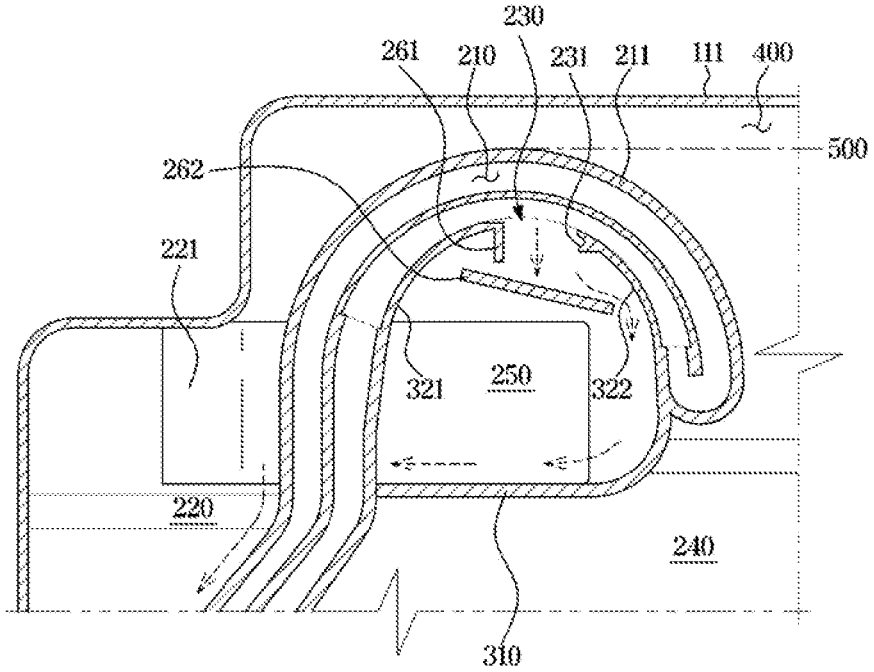
FIG. 8 is a view illustrating a state in which water leaking from an air brake flows to a second flow path through an air brake chamber.
Figure 9:
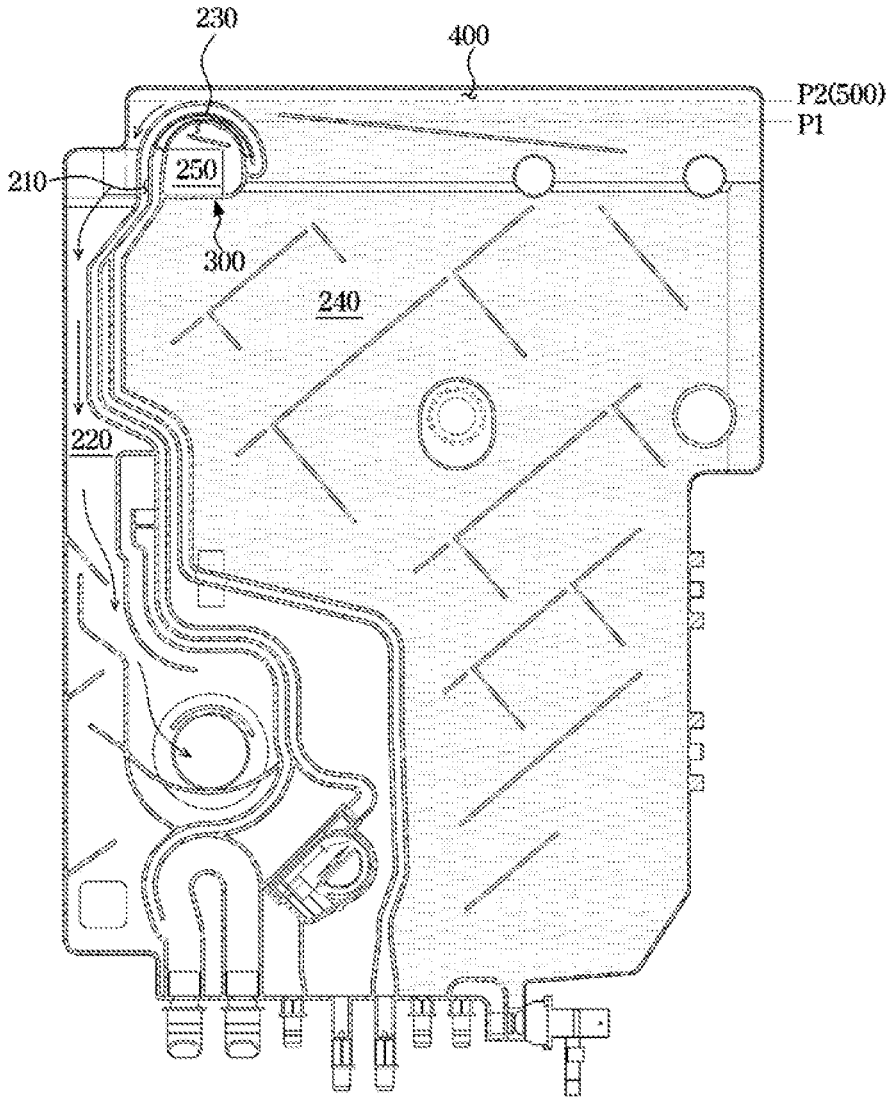
FIG. 9 is a view illustrating the flow of water flowing through an overflow path of a water tank and a second flow path of an air brake assembly according to an embodiment of the disclosure.

FIG. 7 is a view illustrating a first flow path during water supply of an air brake assembly according to an embodiment of the disclosure, FIG. 8 is a view illustrating a state in which water leaking from an air brake flows to a second flow path through an air brake chamber, and FIG. 9 is a view illustrating the flow of water flowing through an overflow path of a water tank and a second flow path of an air brake assembly according to an embodiment of the disclosure.

Referring to FIGS. 7 to 9, a movement path of water moving along the first flow path 210 during supply of water of the air brake assembly 100 is illustrated.

In the supply of water of the air brake assembly 100, water is supplied from the outside through the water supply pipe 131 provided at the lower end of the air brake case 110, and the supplied water moves along the first flow path 210. The water moving along the first flow path 210 passes through the water softener connection part 133 formed at the lower end of the air brake case 110 and then moves to the water softener 160.

As shown in FIG. 8, when the supply of water is stopped, water flowing out from the air brake 230 of the first flow path 210 may be guided by the guide part 260 of the air brake chamber 250 to the second flow path 220 and then introduced into the tub 12.

The water softener 160 includes a soft water tank (not shown) equipped with an ionization resin filter, and a regeneration tank (not shown) that contains substances, such as salt, serving to purify the ionization resin filter on the soft water tank.

Water softened through the water softener 160 may be introduced into the water tank 240 through the water tank inlet 134 and stored therein.

In this case, the air brake assembly 100 according to the disclosure is provided so that a highest water level 500 of water stored in the water tank 240 is higher than a height P1 of the air brake 230, so that the storage capacity of the water tank 240 may be improved.

The partition 300 dividing the air brake chamber 250 from the water tank 240 may allow the water stored in the water tank 240 to be kept apart without being exposed to the air brake 230.

In addition, the overflow path 400 formed at a position higher than the air brake 230 may allow the highest water level 500 of water stored in the water tank 240 to be formed at a height P2 higher than the air brake 230.

Water overflowing from the water tank 240 may be introduced into the tub 12 through the second flow path 220 connected to the overflow path 400. Therefore, in the air brake assembly 100, the highest water level of water stored in the water tank 240 may be provided higher than that of the air brake 230, so that the storage capacity of the water tank 240 may be maximized.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. A dishwasher comprising:

a tub; and an air brake assembly configured to supply water into the tub, wherein the air brake assembly includes:

an air brake case, a first flow path inside the air brake case through which water to be introduced into the air brake case flows, an air brake disposed on the first flow path and configured to prevent backflow of water, an air brake chamber formed by a partition and configured to accommodate water flowing out of the air brake, a second flow path connecting the air brake chamber to the tub to guide water in the air brake chamber to the tub, and a water tank in the air brake case to store water having passed through the first flow path, wherein the partition is connected to a flow path wall forming the first flow path and divides the water tank from the air brake chamber so that a highest level of water stored in the water tank is higher than a height of the air brake.

2. The dishwasher of claim 1, wherein the partition includes a lower wall provided at a lower side of the air brake to form a bottom of the air brake chamber and configured to prevent water of the water tank from flowing into the air brake chamber.

3. The dishwasher of claim 2, wherein the flow path wall formed on the air brake case to define the first flow path, and the partition further includes an upper wall forming a part of the flow path wall and connected to the lower wall to surround the air brake chamber.

4. The dishwasher of claim 3, wherein the water tank includes an overflow path.

5. The dishwasher of claim 4, wherein the overflow path is formed on an upper portion of the flow path wall.

6. The dishwasher of claim 4, wherein the overflow path is formed at a position higher than a position of the air brake.

7. The dishwasher of claim 4, wherein the overflow path is located higher than the air brake chamber.

8. The dishwasher of claim 4, wherein the overflow path is connected to the second flow path.

9. The dishwasher of claim 4, wherein the overflow path is located higher than the second flow path.

10. The dishwasher of claim 3claim 2, wherein the first flow path includespath includes a flow velocity increasing member coupled to the flow path wall to reduce a cross-sectional area so that a flow velocity is increased.

11. The dishwasher of claim 1, wherein the air brake chamber further includes a guide part configured to guide water flowing out of the air brake.

12. The dishwasher of claim 11, wherein the guide part includes:

a first guide rib connected to the air brake and formed with a first slope, and a second guide rib spaced apart from the first guide rib and having a second slope to guide water to the second flow path.

13. The dishwasher of claim 1, wherein the air brake case further includes:

a tub connection hole to allow water moving through the second flow path to flow into the tub.

* * * * *